United States Patent [19]

Myers, Jr.

[11] 4,454,899

[45] Jun. 19, 1984

[54] FIREWOOD LOG SPLITTING ATTACHMENT FOR TRACTORS

[76] Inventor: Charles D. Myers, Jr., 17375 Oakdale Rd., Dallas, Oreg. 97338

[21] Appl. No.: 485,007

[22] Filed: Apr. 14, 1983

[51] Int. Cl.[3] ..... B27L 7/00

[52] U.S. Cl. ..... 144/193 A; 144/366; 280/415 A; 403/87

[58] Field of Search ..... 144/193 R, 193 A, 3 K, 144/366; 280/460 R, 460 A, 461 R, 461 A, 415 R, 415 A; 403/84, 87

[56] References Cited

U.S. PATENT DOCUMENTS 4,285,374 8/1981 Klingel ..... 144/193 A
4,411,298 10/1983 Ellingsen et al. ..... 144/193 A

FOREIGN PATENT DOCUMENTS 3029940 3/1982 Fed. Rep. of Germany ... 144/193 A

*Primary Examiner*—W. D. Bray

[57] ABSTRACT

This log splitting attachment is for use with tractors having the three-point tractor lift assembly, and it is designed to lower down to large logs to be split, and it is also easily pivoted upside down, to split smaller pieces of logs that have been pre-split by the attachment. Primarily, the device consists of an elongated frame, having an hydraulically operated wedge device for splitting logs quickly and safely, and it further includes a hand lever, to prevent rotation of the frame when the attachment is in use.

1 Claim, 4 Drawing Figures

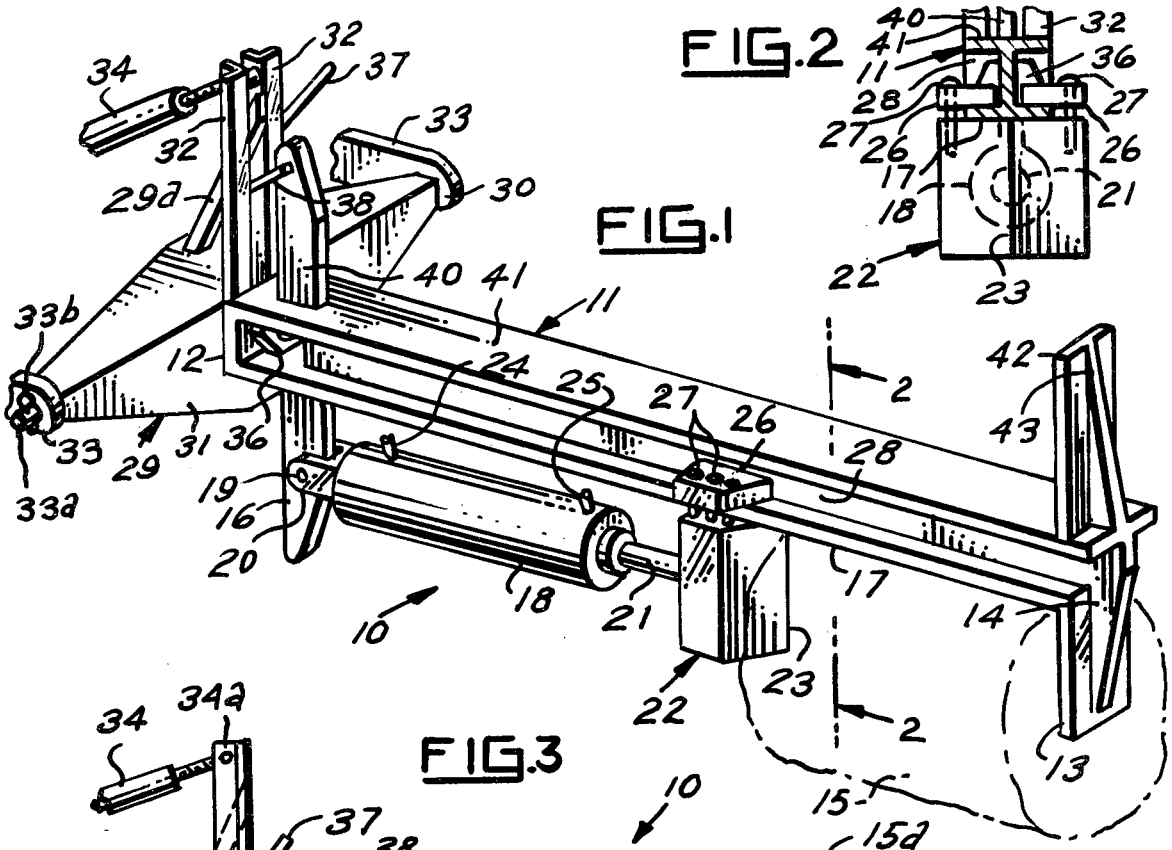
FIG.1
FIG.2
34
32
37
33
30
29a
38
40
41
11
33b
12
24
25
27
26
28
42
43
2
33
29
31
36
33a
19
16
20
10
18
21
17
14
22
23
13
15
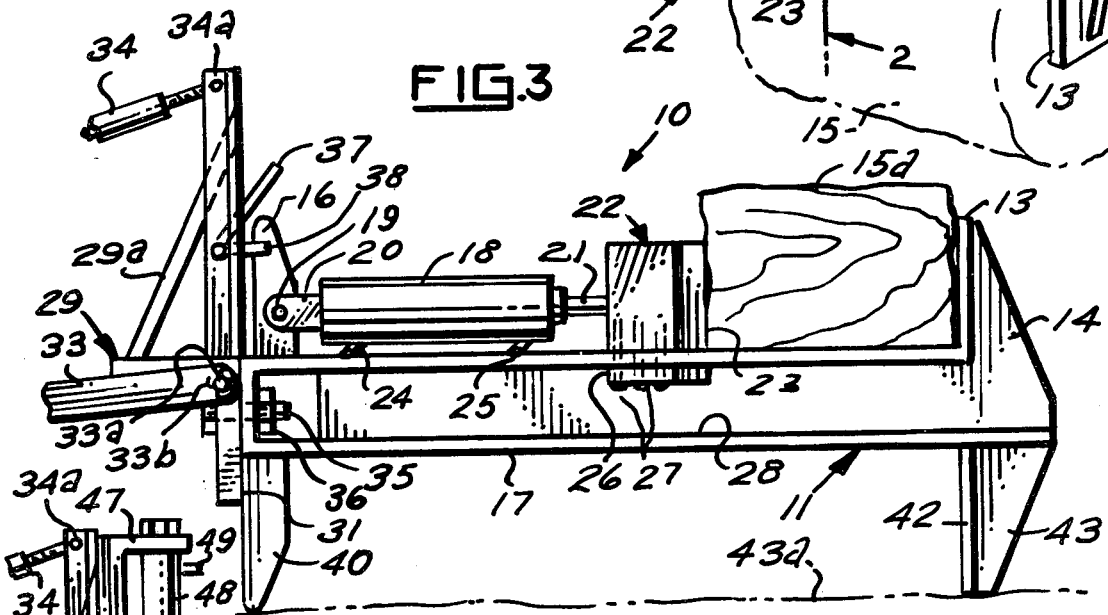
FIG.3
34
34a
37
38
16
19
20
18
21
22
15a
13
29a
29
33
14
24
25
23
33a
33b
35
36
26
27
28
17
11
42
43
31
40
43a
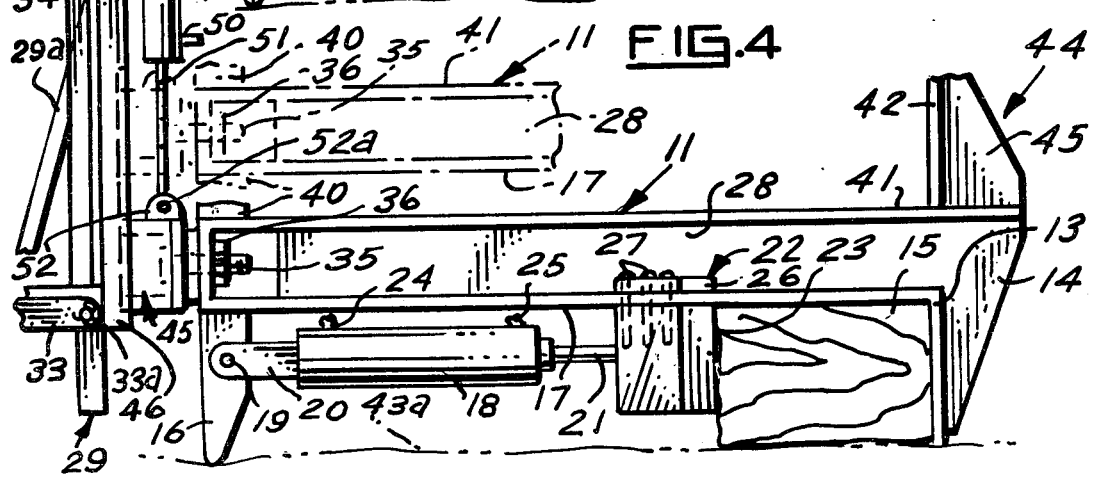
FIG.4
34a
47
49
34
48
50
29a
51
40
35
41
11
36
28
52a
17
44
42
45
52
24
25
27
22
23
15
26
13
14
33
33a
46
45
16
19
20
43a
18
21
29

FIREWOOD LOG SPLITTING ATTACHMENT FOR TRACTORS

This invention relates to log splitting devices, and more particularly, to a fireplace log splitting attachment for tractors.

The principal object of this invention is to provide a firewood log splitting attachment for tractors, which will be employed by tractors having a three-point lift.

Another object of this invention is to provide a firewood log splitting attachment for tractors, which will operate on the principle of hydraulics, as do splitters of the prior art. However, the present invention enables the splitter portion to be lowered onto a large heavy log, so as to eliminate the lifting and manhandling of heavy logs.

Another object of this invention is to provide a firewood log splitting attachment for tractors, which will employ the existing hydraulic system pump and controls of the tractor, or, a quickly attachable pump and remote control may be used, by mounting them on the power take-off shaft of the tractor.

A further object of this invention is to provide a firewood log splitting attachment for tractors, which will be rotatable one hundred and eighty degrees, so as to enable the lighter pieces of wood to be loaded easily onto the machine, for further splitting, if necessary.

Other objects are to provide a firewood log splitting attachment for tractors, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, showing a log in phantom lines;

FIG. 2 is a cross-sectional view, taken along the line 2—2 of FIG. 1;

FIG. 3 is a side view of FIG. 1, shown in inverted position, and

FIG. 4 is a side view of a modified form of the invention, which is shown fragmentary.

According to this invention, an attachment 10 is shown to include an elongated frame 11 of "I"-beam cross-sectional configuration, having an end wall 12 fixedly secured thereto, by welding or other suitable means. A downwardly projecting plate 13 is welded or otherwise secured to the opposite end of frame 11, and is reinforced by a knee plate 14. The combination of the plate 13 and its knee plate 14 serves as a stop against one end of a log 15 that is to be split. A flat bar 16 is fixedly secured to the rear end of a splitting wedge 22, and the point 23 thereof engages with the opposite end of log 15, so as to split it forcefully by the hydraulic cylinder 18 means. The hydraulic lines 24 and 25 of cylinder 18 are connected to the existing hydraulic system pump and controls of the tractor, which is common in the art, and not shown. However, if desired, a quickly attached pump and remote control may be mounted on the power take-off shaft of the tractor. A pair of oppositely opposed guide blocks or plates 26 are secured to the top of splitting wedge 22, by a plurality of bolt fasteners 27, and blocks 26 are in sliding engagement within the channel grooves 28 of frame 11, so as to support the wedge 22 and the piston rod 21 end of cylinder 18.

A horizontal bar 29 of attachment 10, is of "L"-shaped cross-sectional configuration, and tapered at its ends 30. One side 31 of bar 29 engages with end wall 12 of frame 11, and a pair of vertical and spaced-apart angle irons 32 are fixedly secured, at one end, to the top of bar 29, by welding, and a brace bar **29*a* is fixedly secured, at one end, to the top of bar 29, and its opposite end is fixedly secured between and to one of the angle irons 32, by welding or other suitable means. The tractor's three-point hitch assembly, to which attachment 10 is installed, consists of the pair of arms 33, and the stabilizer 34, which is a turnbuckle that is adjustable in length, to regulate the fore and aft angle of an implement. The arms 33 are each secured to the pins 33*a*, which are fixedly secured to the ends of bar 29 by welding, or other suitable means. A cotter pin 33*b* is received in the pins 33*a*, so as to retain the arms 33 thereto, and the stabilizer 34 is fastened between angle irons 32 by pin 34*a*. A threaded bolt 35 is received through end wall 12, and bar 29 and a nut fastener 36 is received thereon. The bolt fastener 35 screws as a pivot point, so as to enable the attachment 10 to be lowered onto a large heavy log 15, which will eliminate the lifting and manhandling of such, and a hand lever 37, having an angularly disposed tongue 38, is pivotally secured, by pin 39, to the angle irons 32, so as to lock attachment 10 in its upright position, or in its inverted position, as illustrated in FIG. 3 of the drawing. A flat bar 40 is welded to the top side 41 of frame 11, adjacent to end wall 12, and serves as a stop against the rotation of attachment 10, when attachment 10 is in its upright position, and when 10 is inverted, bar 40 serves as a support leg from frame 11, in cooperation with a second end plate 42 welded to the top side 41 of frame 11. Second plate 42 also includes a knee plate 43 welded thereto, for reinforcement. When frame 11 is in its upright position, hand lever 37 is pivoted forwardly and downwardly, so as to engage lever 37 with one side of plate 40, and its tongue 38 engages the opposite side of plate 40, which will retain attachment 10 in its upright position. When attachment 10 is to be pivoted to its inverted position, hand lever 37 must be pivoted rearwardly, to disengage with the sides of plate 40, and when attachment 10 is pivoted by bolt 35 to its inverted position, hand lever 37 is again pivoted towards the front of frame 11, so as to engage itself and its tongue 38 with the respective sides of bar 16 of frame 11, so as to render frame 11** stationary against rotation.

In use, attachment 10 is secured to the tractor's three-point lift assembly by connecting the arms 33 to the pins **33*a* with the cotter pins 33*b*, and the stabilizer 34 is secured to the pin 34*a* of the angle irons 32, after which the hydraulic cylinder 18 is coupled to the existing hydraulic system pump and controls of the tractor. The attachment 10 is then lowered over the top of a large log 15, along its longitudinal axis. The hydraulic cylinder 18 is then actuated by the controls on the tractor, which will cause the piston rod 21 to urge its attached splitter wedge 22 against one end of long 15, and the opposite end of log 15 will engage with the plate 13. As the pressure increases, the point 23 of wedge 22 will quickly and forcefully split the log 15. When the above is occurring, the guide blocks 26, within the grooves 28 of frame 11, will keep the wedge 22 true on the general longitudinal axis of the log 15**.

After the abovementioned splitting of large logs 15, the hand lever 37 is pivotally released from engagement with plate 40, and the attachment 10 is rotated one hundred and eighty degrees on the bolt fastener 35, which will invert attachment 10. The hand lever 37 is then rotated to engage with the sides of the plate 16, and the easily manageable previously split chunks of log 15*a* are then loaded onto the surface 17 of frame 11, with one end thereof engaging with plate 13, which is now on the top of attachment 10, and the plates 40 and 43 serve as ground support legs for frame 11 on the ground 43*a*. The smaller logs 15*a* are then split in the same manner as was heretofore described.

Referring now to FIG. 4 of the drawing, a modified form of attachment 44 is shown to include all of the component members, as was heretofore described of the first embodiment of the invention, with the exception that frame 11 is now elevatable, by being secured to a carriage member 45, rather than to bar 29, and member 45 is slideably received and retained in a vertical and "U"-shaped channel member 46, that is secured to the angle irons 32. The bolt 35 and nut fastener 36 are now pivotally secured to carriage 45. Channel member 46 is terminated, at its top end, by a mounting lug 47, in which is secured one end of a second hydraulic cylinder 48, having lines 49 and 50 that are coupled to the tractor, in the same manner heretofore described of cylinder 18, so as to elevate and lower attachment 44. The piston rod 51 of second cylinder 48 is secured to lugs 52 by a suitable pin 52*a*, and lugs 52 are fixedly secured to the top of carriage member 45, by welding.

In use, attachment 44 is secured to the three-point tractor assembly, in the same manner heretofore described of attachment 10, and the functions of 44 are entirely the same as attachment 10, with the exception, that the frame 11, of 44, is elevatable by the actuation of the second hydraulic cylinder 48, through the attached carriage member 45, that is slideably retained and guided within channel member 46.

While various changes may be made in the detail construction, it is understood that such changes will be within the spirit and scope of the present invention, as is defined by the appended claims.

What I now claim is:

1. A firewood log splitting attachment for tractors, comprising, in combination, a general horizontal, elongated frame pivotable about its longitudinal axis on a bolt projecting from one end of said frame, said bolt being supported on a three point hitch assembly mounted on a tractor, an upward leg and a downward leg fixably mounted on said one end of said frame, an upward plate and a downward plate rigidly affixed on an opposite end of said frame, one of said plates serving as yet another leg while the other plate serves as a log-abutting stop, a hydraulic cylinder mounted on one of said legs, a splitting wedge on an end of a piston rod of said hydraulic cylinder, guide means carried by said splitting wedge for sliding support along said frame in order to split a firewood log positioned between said wedge and said stop which is aligned with said wedge; said three point hitch assembly comprising a pair of side arms and a central, upward turnbuckled stabilizer extending from said tractor, a horizontal transverse bar having a pair of upward, spaced-apart angle irons mounted thereupon, said arms pivotally supporting opposite ends of said transverse bar while said stabilizer is pivotally attached between the upper ends of said angle irons, said transverse bar supporting said bolt; and a latch securing said frame in selected pivoted position on said bolt, said latch comprising a cross-pin pivotally supported between said angle irons, a radially extending handle affixed to one end of said cross-pin and a radially extending tongue affixed on said cross-pin and being located between said angle irons for locking either of said legs between said handle and said tongue when said frame is pivoted on said bolt so that said wedge and said stop are on an underside of said frame for spliting heavy logs resting on the ground, or else being on an upper side of said frame for splitting a lightweight log chunk placed upon said frame.

* * * * *